US009767818B1

(12) United States Patent
Jain et al.

(10) Patent No.: US 9,767,818 B1
(45) Date of Patent: Sep. 19, 2017

(54) STEERABLE BEAMFORMER

(71) Applicant: Marvell International Ltd., Hamilton (BM)

(72) Inventors: Kapil Jain, Santa Clara, CA (US); Haiying Xia, Stanford, CA (US)

(73) Assignee: Marvell International Ltd., Hamilton (BM)

( * ) Notice: Subject to any disclaimer, the term of this patent is extended or adjusted under 35 U.S.C. 154(b) by 316 days.

(21) Appl. No.: 14/024,802

(22) Filed: Sep. 12, 2013

Related U.S. Application Data

(60) Provisional application No. 61/702,483, filed on Sep. 18, 2012.

(51) Int. Cl.
*G10L 21/0208* (2013.01)
*H04S 7/00* (2006.01)
*G10L 21/0216* (2013.01)

(52) U.S. Cl.
CPC ..... *G10L 21/0208* (2013.01); *H04S 7/30* (2013.01); *G10L 2021/02165* (2013.01); *G10L 2021/02166* (2013.01); *H04R 2430/23* (2013.01)

(58) Field of Classification Search
CPC ..... G10L 21/0208; G10L 2021/02165; G10L 2021/02166; H04R 2430/21; H04R 2430/23; H04R 2430/25; H04S 7/30
USPC ..... 381/17, 94.7, 97
See application file for complete search history.

(56) References Cited

U.S. PATENT DOCUMENTS

| | | | | |
|---|---|---|---|---|
| 5,581,620 | A * | 12/1996 | Brandstein et al. | 381/92 |
| 8,184,801 | B1 * | 5/2012 | Hamalainen | 379/406.03 |
| 2007/0025562 | A1 * | 2/2007 | Zalewski | H04R 3/005 381/92 |
| 2009/0240495 | A1 * | 9/2009 | Ramakrishnan et al. | 704/226 |
| 2011/0058676 | A1 * | 3/2011 | Visser | 381/17 |
| 2014/0003611 | A1 * | 1/2014 | Mohammad | H04R 3/005 381/66 |

OTHER PUBLICATIONS

Lewis, Jerad, "Microphone Array Beamforming", 2012, Analog Devices, AN-1140, pp. 1-8.*

* cited by examiner

*Primary Examiner* — Davetta W Goins
*Assistant Examiner* — Daniel Sellers

(57) ABSTRACT

Some of the embodiments of the present disclosure provide a device comprising: a first channel configured to receive a signal, wherein the signal comprises (i) a target signal and (ii) a background signal; a second channel configured to receive the signal a time t after the first channel receives the signal; a delay control circuit configured to iteratively determine a fractional delay to maximize a correlation coefficient between the signal on the first channel and the signal on the second channel; and an adaptive fractional delay filter in the first channel configured to adaptively align, in the digital domain, the signal on the first channel with the signal on the second channel based, at least in part, on the fractional delay.

18 Claims, 4 Drawing Sheets

STEERABLE BEAMFORMER

CROSS REFERENCE TO RELATED APPLICATIONS

This disclosure claims priority to U.S. Provisional Patent Application No. 61/702,483, filed Sep. 18, 2012, which is incorporated herein by reference.

TECHNICAL FIELD

Embodiments of the present disclosure relate to sound source localization, and more particularly, to sound source localization in a noisy environment.

BACKGROUND

Unless otherwise indicated herein, the approaches described in this section are not prior art to the claims in the present disclosure and are not admitted to be prior art by inclusion in this section.

Often, a microphone picking up an intended audio signal will also be subjected to other undesirable audio signals. For example, while picking up speech of a user of a handheld phone, a microphone of the handheld phone can also pick up background chatter of other conversations, fan noise of nearby electronic devices, and other interference audio signals of a noisy environment. Moreover, intensities and/or directions of intended (target) audio signals and unintended interference audio signals may change over time.

SUMMARY

In various embodiments, the present disclosure provides a device comprising: a first channel configured to receive a signal, wherein the signal comprises (i) a target signal and (ii) a background signal; a second channel configured to receive the signal a time t after the first channel receives the signal; a delay control circuit configured to iteratively determine a fractional delay to maximize a correlation coefficient between the signal on the first channel and the signal on the second channel; and an adaptive fractional delay filter in the first channel configured to adaptively align, in the digital domain, the signal on the first channel with the signal on the second channel based, at least in part, on the fractional delay.

In other embodiments, the present disclosure provides a method comprising: receiving a signal on a first channel, wherein the signal comprises (i) a target signal and (ii) a background signal; a time t after the first channel receives the signal, receiving the signal on a second channel; and iteratively determining a fractional delay to maximize a correlation coefficient between the signal on the first channel and the signal on the second channel; and adaptively aligning, in the digital domain, the signal on the first channel with the signal on the second channel based, at least in part, on the fractional delay.

In still other embodiments, the present disclosure provides a system comprising: a signal source locator configured to receive a signal on a first channel, wherein the signal comprises (i) a target signal and (ii) a background signal, to receive the signal on a second channel a time t after the first channel receives the signal, to iteratively determine a fractional delay to maximize a correlation coefficient between the signal on the first channel and the signal on the second channel; and to adaptively align, in the digital domain, the signal on the first channel with the signal on the second channel based, at least in part, on the fractional delay. The system further comprises a beamformer configured to amplify the target signal based, at least in part, on (i) the signal adaptively aligned on the first channel and (ii) the signal on the second channel, and to suppress the background signal based, at least in part, on (i) the signal delayed on the first channel and (ii) the signal on the second channel.

BRIEF DESCRIPTION OF THE DRAWINGS

In the following detailed description, reference is made to the accompanying drawings which form a part hereof wherein like numerals designate like parts throughout, and in which is shown by way of embodiments that illustrate principles of the present disclosure. It is to be understood that other embodiments may be utilized and structural or logical changes may be made without departing from the scope of the present disclosure. Therefore, the following detailed description is not to be taken in a limiting sense, and the scope of embodiments in accordance with the present disclosure is defined by the appended claims and their equivalents.

DETAILED DESCRIPTION

Example embodiments herein describe a number of devices, systems, and techniques for electronically steering detection of a target signal source, such as, for example, an acoustic source or an electromagnetic field source. In some implementations, for example, electronically steering detection of a sound source involves a steerable beamformer for sound source localization. A steerable beamformer suppresses background signals received from background sources while passing a desired target signal. Such implementations are useful for a number of applications, including mobile, handheld device applications, where a user in motion is talking in a noisy environment. In this case, a target signal may be the user's voice. Accordingly, a steerable beamformer isolates the user's voice from any number of noisy background signals. Isolating the user's voice enables amplifier circuits, for example, to amplify the user's voice and not the (one or more) background signals, so that a listener can more clearly hear a user's voice speaking into the handheld device.

Signal direction is herein defined with respect to a steerable beamformer having two or more receivers that lie in a plane. Signal direction (e.g., line of travel from signal source to steerable beamformer) is described with reference to a direction perpendicular to the plane. For a process of electronic steering detection, direction of a target signal and one or more background signals are initially arbitrary. Moreover, direction of the target signal and background signals may change with time. For example, a user talking into a handheld device incorporating a steerable beamformer may move with respect to the handheld device. In another example, one or more background signals of a noisy environment may move with respect to one another and/or the handheld device, since background sources need not be stationary. In yet another example, the handheld device may move with respect to the one or more background signals. Though examples are directed to acoustic cases, embodiments described herein may involve acoustic or electromagnetic signals.

Figure 1:
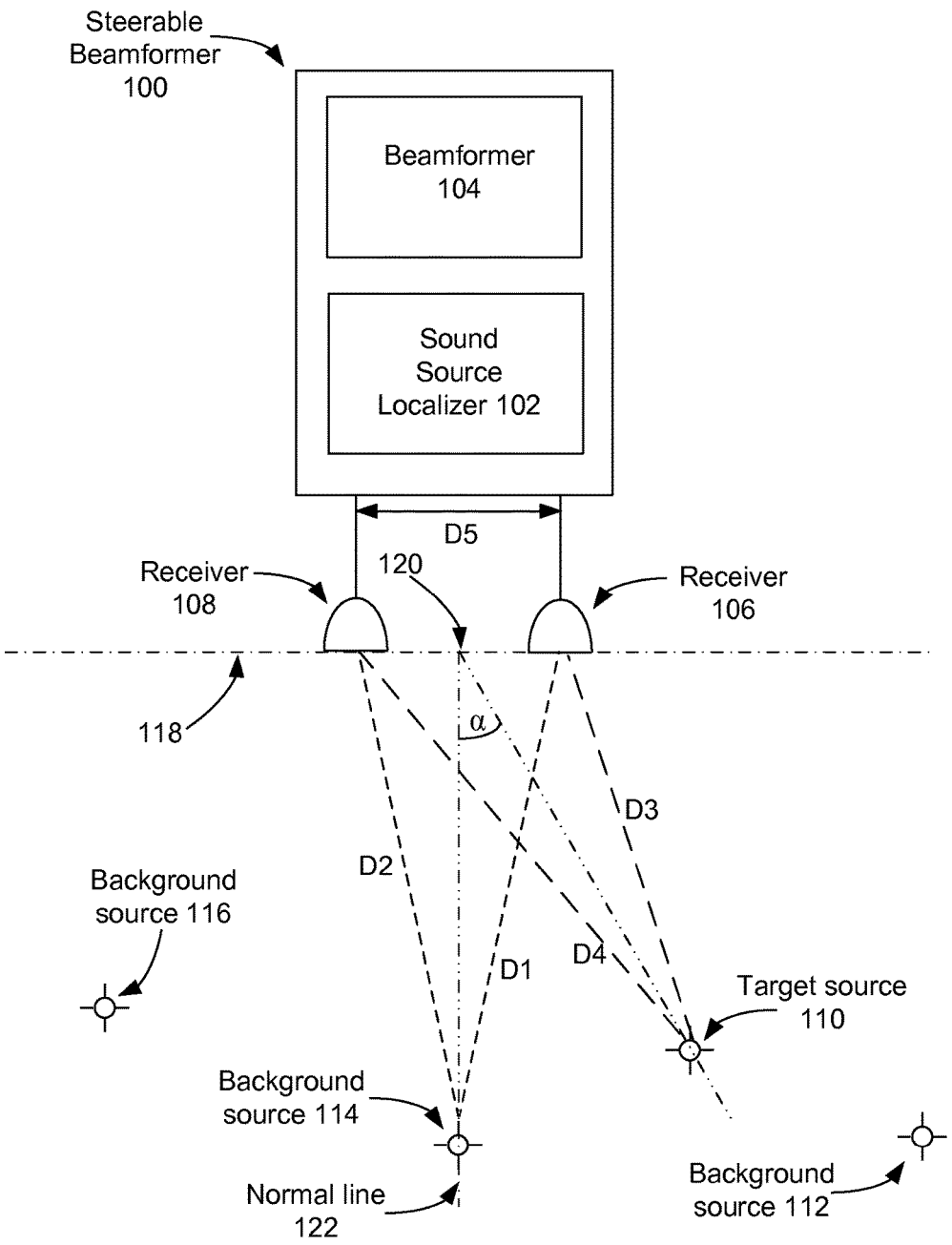
FIG. 1 schematically illustrates a steerable beamformer and several example signal sources, according to embodiments.

FIG. 1 schematically illustrates a steerable beamformer 100 and several example signal sources, according to embodiments. Steerable beamformer 100 includes a sound source localizer (SSL) 102, a beamformer 104, a first receiver 106, and a second receiver 108. For implementations involving acoustic signals, first and second receivers comprise microphones or other sound wave detectors. For implementations involving electromagnetic signals, first and second receivers comprise antennas or other electromagnetic wave detectors.

Signal sources comprise a target signal source and one or more background signal sources. In particular, FIG. 1 shows a target signal source 110, a first background signal source 112, a second background signal source 114, and a third background signal source 116. In the case of acoustic sources, a target signal source may comprise a distant voice or a voice of a user of a handheld device, sound from a distant acoustic speaker (or set of speakers spaced relatively close to one another compared to their distance from steerable beamformer 100), and so on. Background signal sources may comprise any number of sources of a noisy environment. For example, background signal sources can comprise voices of one or more people other than that of a user of a handheld device. In other examples, background signal sources can generate traffic noises, various room noises, office equipment noises, construction noises, and so on. In the case of electromagnetic sources, a target signal source may comprise a particular transmission antenna, while background signal sources comprise one or more other transmission antennas.

Distance between a signal source and a receiver determines, in part, the time it takes for a signal from the signal source to reach the receiver. This time is called time-of-flight (ToF). Thus, for example, ToF of a signal from a nearby source is less than ToF of a signal from a more distant source. Accordingly, the signal from the more distant source will lag the signal from the nearby source by a "lag time". In a converse example that includes one source and two receivers, ToF of a signal from a single source to a nearby receiver is less than ToF of a signal from the single source to a more distant receiver.

Referring to signal sources shown in FIG. 1, background signal source 114 is a distance D1 from receiver 106 and a distance D2 from receiver 108. In a particular example, D1 is equal to D2, so that background signal source 114 is equidistant from receivers 106 and 108. Accordingly, ToF of the signal from background signal source 114 to receiver 106 is equal to ToF of the signal from background signal source 114 to receiver 108.

In another example, target signal source 110 is a distance D3 from receiver 106 and a distance D4 from receiver 108. In a particular example, D4 is greater than D3, so that target signal source 110 is closer to receiver 106 than to receiver 108. Accordingly, ToF of the signal from target signal source 110 to receiver 106 is less than ToF of the signal from target signal source 110 to receiver 108.

As mentioned above, signal direction (e.g., line of travel from signal source to steerable beamformer 100) is described with reference to a direction perpendicular to a plane 118 defined by receivers 106 and 108 (and any additional receivers that can be present in other embodiments). A center point 120 is a point on plane 118 equidistant from first and second receivers 106 and 108. "Look direction" of a signal source, such as 110 or 114 for example, is described as an angle between a line from center point 120 to the signal source and a normal line 122 perpendicular to plane 118. Thus, for example, background source 114 is at a zero-angle look direction, and target source 110 is at a look direction a.

Knowing a separation distance D5 between receivers 106 and 108, look direction of a particular signal source (e.g., 110, 112, 114, or 116) can be determined by considering the ToF from the particular signal source to each of receivers 106 and 108. Look direction of the particular signal source depends, at least in part, on a difference between ToF from the particular signal source to receiver 106 and ToF from the particular signal source to receiver 108. For example, a zero-angle look direction of background signal source 114 occurs when ToF's from the background signal source 114 to each of receivers 106 and 108 are the same. On the other hand, a nonzero-angle look direction of target signal source 110, for example. occurs when the ToF's from the signal source to each of receivers 106 and 108 are different.

Figure 2:
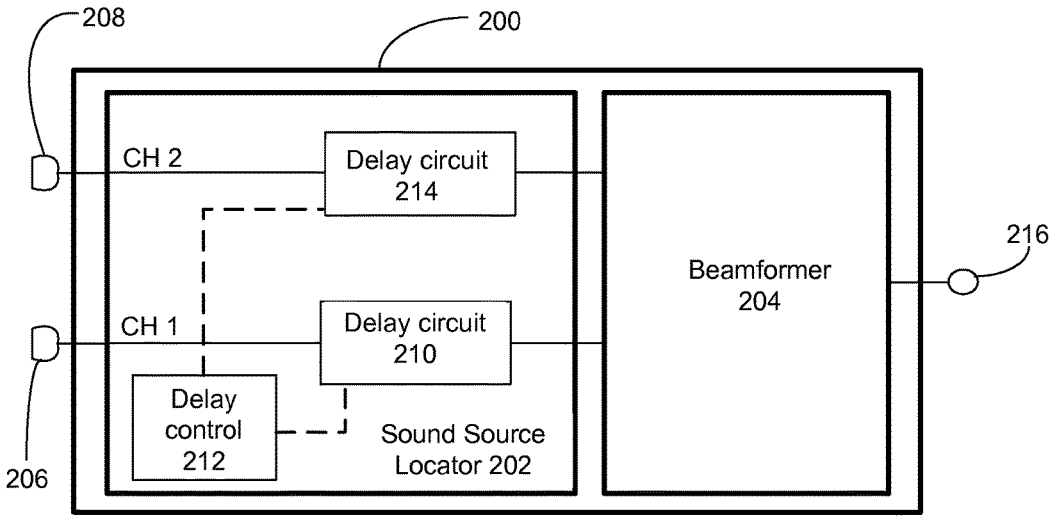
FIG. 2 is a block diagram of a steerable beamformer, according to some embodiments.

FIG. 2 is a block diagram of a steerable beamformer 200, according to some embodiments. Steerable beamformer 200 includes an SSL 202, a beamformer 204, a first receiver 206, and a second receiver 208. For implementations involving acoustic signals, first receiver 206 and second receiver 208 comprise microphones or other sound wave detectors. For implementations involving electromagnetic signals, first receiver 206 and second receiver 208 comprise antennas or other electromagnetic wave detectors.

First receiver 206 provides electronic signals to channel 1 and second receiver 208 provides electronic signals to channel 2. Channel 1 includes a delay circuit 210 that can impose a time delay on electronic signals from first receiver 206. A delay control 212 is electrically connected to delay circuit 210 and can adjust the amount of time delay that delay circuit 210 imposes on signals from first receiver 206. The electronic signal on channel 1, which may be delayed by delay circuit 210, is provided to beamformer 204. Channel 2 includes a delay circuit 214 that can impose a time delay on electronic signals from second receiver 208. Delay control 212 is electrically connected to delay circuit 214 and can adjust the amount of time delay that delay circuit 214 imposes on signals from second receiver 208. The electronic signal on channel 2, which may be delayed by delay circuit 214, is provided to beamformer 204.

Delay control 212 can adjust amounts of delay imposed on signals on channels 1 and 2 by delay circuits 210 and 214, respectively. Such delay amounts can be adjusted so that a signal received on channel 1 (via first receiver 206) is delayed relative to a signal received on channel 2 (via second receiver 208). Similarly, delay amounts can be adjusted so that a signal received on channel 2 is delayed relative to a signal received on channel 1. Adjusting delay amounts enables SSL 202 to synchronize the signals received on channels 1 and 2. Such synchronization can be useful when two signals from a single particular source arrive at first receiver 206 and second receiver 208 at different times. This occurs, for example, when first receiver 206 and second receiver 208 are at different distances from the particular source. The difference in these distances is based, at least in part, on the direction of the particular source from steerable beamformer 200. For example, if the particular source is equidistant from first receiver 206 and second receiver 208, then the difference in these distances is zero and the particular source is at a zero-angle look direction. This is the case for background signal source 114 shown in FIG. 1. On the other hand, if the particular source is closer to first receiver 206 than to second receiver 208, then the non-zero difference in these distances leads to a time lag between signals received at first receiver 206 and second receiver 208. The time lag can be used to determine the look direction of the particular source. This is the case for target signal source 110 shown in FIG. 1.

If a signal from a single particular source received on channel 1 leads the signal received on channel 2, then delay control 212 can adjust delay circuit 210 to time-delay the signal on channel 1, and not impose any delay on the signal on channel 2, so that the delayed signal on channel 1 is synchronized with the signal on channel 2. The amount of delay needed to synchronize the two signals can be used to determine look direction of the particular source. In various embodiments, synchronization performed by SSL 202 can be based on a target signal so that target signal components of synchronized signals are in phase with one another. In other words, a signal on channel 1 is delayed by a time delay that aligns (in a time scale) the target signal in channel 1 with the target signal in channel 2. Signals on channels 1 and 2 synchronized or aligned in this fashion appear to beamformer 204 as signals emitted from a target signal source at a zero-angle look direction, while background signal sources are at nonzero look directions. Synchronized signals are provided to beamformer 204, which passes the target signal coming from the zero angle look-direction and substantially rejects background signals in other directions. Thus, beamformer 204 can selectively amplify a target signal while comparably suppressing one or more background signals received by first receiver 206 and second receiver 208. The amplified signal is provided as an output signal source at output port 216, which can be applied to a loud speaker or a headphone, in the case of acoustic signals, for example.

Figure 3:
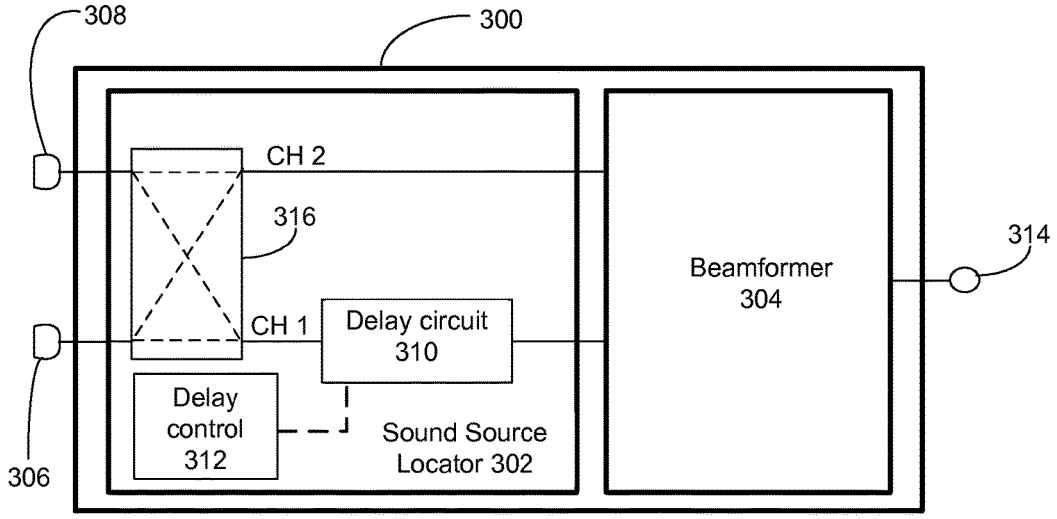
FIG. 3 is a block diagram of a steerable beamformer, according to other embodiments.

FIG. 3 is a block diagram of a steerable beamformer 300, according to some embodiments. Steerable beamformer 300 includes an SSL 302, a beamformer 304, a first receiver 306, and a second receiver 308. For implementations involving acoustic signals, first receiver 306 and second receiver 308 comprise microphones or other sound wave detectors. For implementations involving electromagnetic signals, first receiver 306 and second receiver 308 comprise antennas or other electromagnetic wave detectors.

First receiver 306 provides electronic signals to channel 1 and second receiver 308 provides electronic signals to channel 2. Channel 1 includes a delay circuit 310 that can impose a time delay on electronic signals from first receiver 306. A delay control 312 is electrically connected to delay circuit 310 and can adjust the amount of time delay that delay circuit 310 imposes on signals from first receiver 306. The electronic signal on channel 1, which may be delayed by delay circuit 310, is provided to beamformer 304. Channel 2 does not include a delay circuit. The non-delayed electronic signal on channel 2 is also provided to beamformer 304. In turn, beamformer 304 can selectively amplify a target signal while comparably suppressing one or more background signals received by first receiver 306 and second receiver 308. The amplified signal is provided as an output signal source at output port 314.

Delay control 312 can adjust amounts of delay imposed on signals on channel 1 by delay circuit 310. Such delay amounts can be adjusted so that a signal received on channel 1 (via first receiver 306) is delayed relative to a signal received on channel 2 (via second receiver 308). Adjusting delay amounts enables SSL 302 to synchronize the signals received on channels 1 and 2. If a signal from a single particular source received on channel 1 leads the signal received on channel 2, then delay control 312 can adjust delay circuit 310 to time-delay the signal on channel 1 so that the delayed signal on channel 1 is synchronized with the signal on channel 2. The amount of delay needed to synchronize the two signals can be used to determine look direction of the source.

The description above for synchronization between signals on channels 1 and 2 is for the case where the signal received by receiver 308 on channel 2 lags the signal received by receiver 306 on channel 1. This, however, need not be the case: the signal received by receiver 308 on channel 2 can lead the signal received by receiver 306 on channel 1. With a delay circuit on channel 1 and no delay circuit on channel 2, SSL 302 as described above is not capable of synchronizing a signal on channel 2 with a lagging signal on channel 1. This is because delay circuit 310 cannot impose a negative delay. To address this issue, an input control block 316 is capable of switching inputs so that signals from either receiver 306 or 308 can be placed on either channel 1 or channel 2. Input control block 316 can thus be operated so that a lagging signal is placed on channel 2 and a leading signal is placed on channel 1, which includes delay circuit 310.

In various embodiments, input control block 316 comprises digital electronic circuitry, including multiplexers and logic circuitry. In other embodiments, operations performed by input control block 316 may be implemented by a processor executing code or may be implemented by a combination of hardware, software, and firmware.

Figure 4:
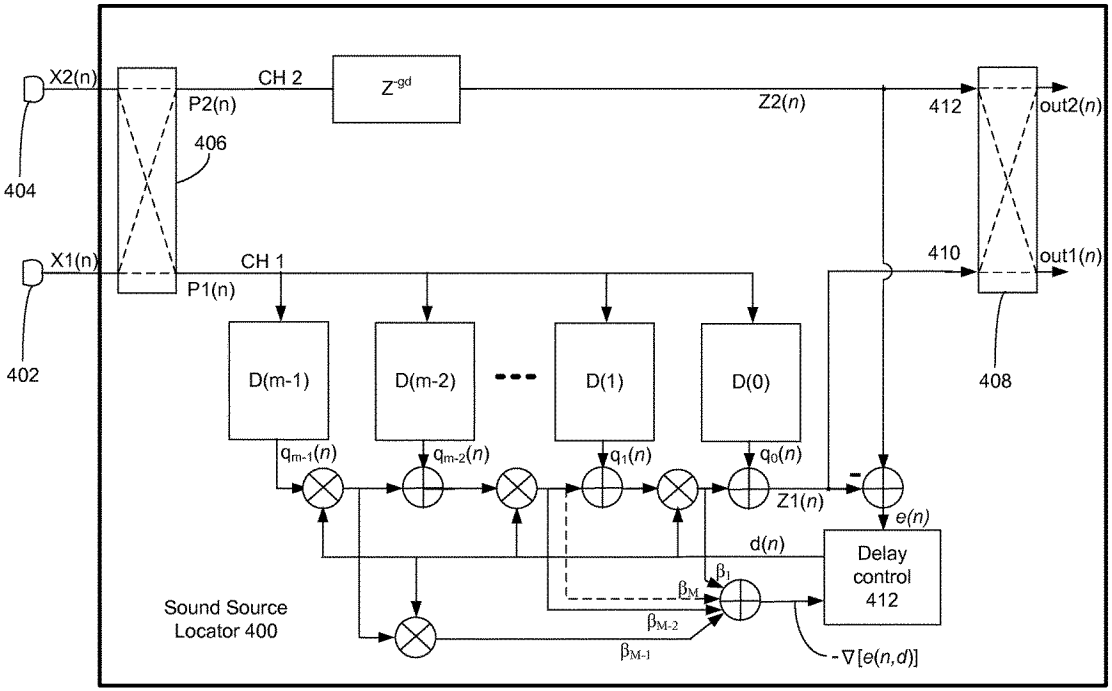
FIG. 4 is a block diagram of a portion of a steerable beamformer, according to embodiments.

FIG. 4 is a block diagram of a portion of a steerable beamformer comprising an SSL 400 and two receivers 402 and 404 having substantially identical characteristics, according to embodiments. Receivers 402 and 404 are set apart by a distance that is appropriate in view of anti-aliasing considerations and spatial filtering. For example, a distance can be selected so that a highest frequency part of signals received by receivers 402 and 404 (e.g., determined to be half of a sampling rate) is not spatially aliased. In some implementations, signal sources, such as sources 110, 112, 114, and 116, are considered to emit signals that propagate via plane wave fronts. Thus, differences between inputs of receivers 402 and 404 are due to delays from ToF, which depends on the direction of the signals.

As explained above for SSL 202, SSL 400 includes delay circuits to adjust delay of one signal versus another signal so that the direction of a target signal aligns with a look-direction of a Beamformer. For example, the look-direction of the Beamformer can be zero-angle. SSL 400 detects the direction of a target signal, wherein the target signal has larger energy then one or more background signals.

SSL 400 includes a fractional delay filter comprising m FIR filters D(m), where m=0, 1, 2, . . . . In some implementations, for example, such a fractional delay filter comprises a Farrow Fractional Delay Filter (FDF). The FIR filters D(m) are on channel 1, whereas channel 2 does not include an FDF. However, channel 2 includes a delay block $Z^{-gd}$ to account for a group delay introduced by FDF in channel 1. For example, FDF in channel 1 introduces a fractional delay and an integer delay. Block $Z^{-gd}$ compensates for the integer delay between channel 1 and channel 2. Input control block 406 selects which signal, X1($n$) or X2($n$), received by receivers 402 and 404 is applied to channel 1. As discussed above, the leading signal is applied to channel 1. The index n is a sampling index over time in the digital domain.

To determine synchronization between signals on channel 1 and channel 2 so that a target signal appears to be located at a zero-angle look-direction, a delay is imposed on the leading signal X1($n$) or X2($n$) so that a correlation coefficient in the time domain between signals Z1($n$) and Z2($n$) is at a local maxima. For example, if X1($n$) or X2($n$) are equal (e.g., a target source is equidistant from receivers 402 and 404), then a correlation coefficient between signals Z1($n$) and Z2($n$) are at a local maxima without imposing a delay of either X1($n$) and X2($n$). In fact, imposing a delay would reduce the correlation coefficient in this case. If, however, the target signal source is in a direction other than a look-direction of 0°, this would mean that the correlation coefficient between input Z1($n$) and Z2($n$) will be relatively low (<<1). Thus, imposing delay on a leading signal (X1($n$) or X2($n$)) can increase the correlation coefficient as the phase difference of the signals approaches zero. After imposing such delay, output signals Z1($n$) and Z2($n$) appear as if they were coming from the look-direction of 0°. Output signals Z1($n$) and Z2($n$) can be provided to a beamformer, such as beamformer 314 shown in FIG. 3, via output ports out1($n$) and out2($n$). Input control block 408 selects which signal Z1($n$) or Z2($n$), at input ports 410 and 412, respectively, to provide at output ports out1($n$) and out2($n$) so that output port out1($n$) provides the signal X1($n$) and that output port out2($n$) provides the signal X2($n$) regardless of which channel was processed by the FDF.

SSL 400 includes a delay control 412 that generates a delay parameter signal d(n) that determines the amount of delay imposed by FIR filters D(m). Delay control 412 can use any of a number of techniques to adjust delay parameter d(n). Such techniques include LMS, Correlation LMS (CLMS), and Normalized LMS (NLMS), just to name a few examples. In an example embodiment below, LMS is used.

As mentioned above, output signals Z1($n$) and Z2($n$) can be provided to a beamformer, such as beamformer 314 shown in FIG. 3, via output ports out1($n$) and out2($n$). Since these signals are already aligned by FIR filters D(m) in SSL 400, any type of beamformer with look-direction of 0° can be used. However, because of possible residual estimating errors generated during processes performed by SSL 400, signals Z1($n$) and Z2($n$) provided to the beamformer may not be completely aligned. To account for this, the beamformer may have a flattened/widened beam-pattern response centered at the look-direction. This beam-pattern may include a transition band is relatively sharp, so that background signals located near the target signal can be substantially attenuated.

In some embodiments, a description of operations of SSL 400 can be generalized to involving any number of channels. Signals generated by SSL 400 can be written as $$Z1(n) = \sum_{m=0}^{M-1} q_m(n) \cdot d^m(n),$$

where Z1($n$) is the signal on channel 1 for the nth sample, $q_m$(n) is the output of the mth FIR filter for the nth sample, and $d^m$(n) is the delay imposed by the mth FIR filter for the nth sample.

The output of the mth FIR filter on the nth sample can be written as $$q_m(n) = \sum_{k=0}^{N-1} P1(n-k)C_{k,m},$$

where P1($n-k$) is the input signal of the FIR filter D(m) for the nth sample, k is an index, and $C_{k,m}$ is a multiplier for the mth FIR filter. The signal for an nth sample that does not include FIR filters D(m) can be written as Z2($n$)=P2($n-gd$), where P2($n-gd$). A feedback signal e(n, d) applied to delay control 412 can be expressed as e(n,d)=Z2($n$)−Z1($n$). Substituting the expression above, $$e(n, d) = P2(n-gd) - \sum_{m=0}^{M-1} q_m(n) \cdot d^m(n),$$

which becomes $$e(n, d) = P2(n-gd) - \sum_{m=0}^{M-1} \sum_{k=0}^{N-1} P1(n-k)C_{k,m}d^m(n).$$

Taking the gradient of e(n,d), $$\nabla e(n, d) = \frac{\partial e(n, d)}{\partial d},$$

and through substitution and grouping into "β-terms":

$$\nabla e(n, d) = \frac{\partial\left[P2(n-gd) - \sum_{m=0}^{M-1} \sum_{k=0}^{N-1} P1(n-k)C_{k,m}d^m(n)\right]}{\partial d}$$

$$\nabla e(n, d) = -\sum_{m=0}^{M-1} \sum_{k=0}^{N-1} P1(n-k)C_{k,m}(md^{m-1}(n))$$

$$\nabla e(n, d) = -\sum_{m=0}^{M-1} q_m(n)md^{m-1}$$

$$-\nabla e(n,d)=q_1+2dq_2(n)+3d^2q_3(n)+\ldots(M-1)d^{M-2}q_{M-1}(n)$$

$$-\nabla e(n,d)=[q_1+dq_2(n)+d^2q_3(n)+\ldots d^{M-2}q_{M-1}(n)]+[dq_2(n)+d^2q_3(n)+\ldots d^{M-2}q_{M-1}(n)]+[d^2q_3(n)+\ldots d^{M-2}q_{M-1}(n)]+\ldots[d^{M-2}q_{M-1}(n)].$$

$$-\nabla e(n,d)=\beta_1+\beta_2+\ldots\beta_{M-1}$$

$$-\nabla e(n, d) = \sum_{j=1}^{M=1} \beta_j$$

Accordingly, delay control 412 applies signals expressed as d(n+1)=d(n)−μ(n)·e(n,d)·∇e(n,d). Accordingly, the delay term is iteratively modified among sampling index n. The factor μ(n) is a control parameter that can be adjusted to a desired balance between rate of convergence to an optimal delay value and residual error. The β-terms arise from a judicious grouping the expansion of the summation for $\nabla e(n,d)$. Though the example embodiment of FIG. 4 shows four FIR filters (e.g., a $3^{rd}$-order FDF), summations of the above terms can be expanded to any mth order.

Figure 5:
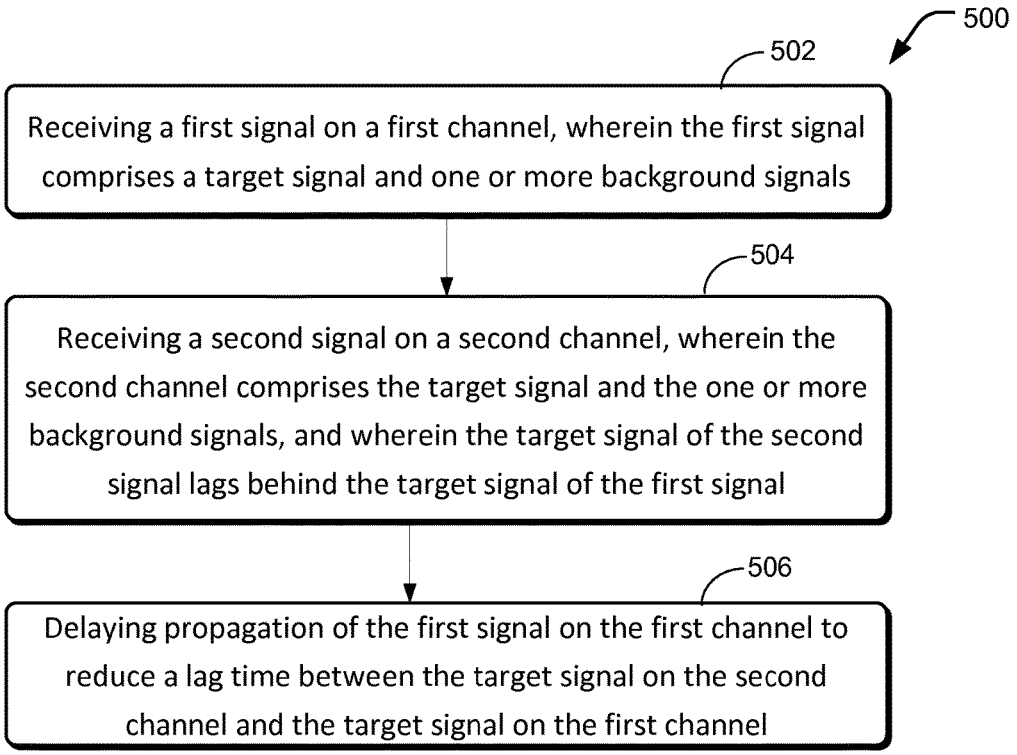
FIG. 5 is a flow diagram of a process of operating a steerable beamformer, according to embodiments.

FIG. 5 is a flow diagram of a process 500 of operating a steerable beamformer, such as beamformers 104, 204 and 304, according to embodiments. At block 502, the steerable beamformer receives a first signal on a first channel, wherein the first signal comprises a target signal and one or more background signals. At block 504, the steerable beamformer receives a second signal on a second channel, wherein the second channel comprises the target signal and the one or more background signals, and wherein the target signal of the second signal lags behind the target signal of the first signal. At block 506, the steerable beamformer delays propagation of the first signal on the first channel to reduce a lag time between the target signal on the second channel and the target signal on the first channel.

In accordance with various embodiments, an article of manufacture may be provided that includes a storage medium having instructions stored thereon that, if executed, result in the operations described herein with respect to process 500 of FIG. 5 (and/or various other operations discussed herein). In an embodiment, the storage medium comprises some type of non-transitory memory. In accordance with various embodiments, the article of manufacture may be a computer-readable medium such as, for example, software or firmware. In some embodiments, a system may comprise an SSL configured to perform process 500.

As used herein, the term "module" or "block" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

The description incorporates use of the phrases "in an embodiment," or "in various embodiments," which may each refer to one or more of the same or different embodiments. Furthermore, the terms "comprising," "including," "having," and the like, as used with respect to embodiments of the present disclosure, are synonymous.

Various operations may have been described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Although specific embodiments have been illustrated and described herein, it is noted that a wide variety of alternate and/or equivalent implementations may be substituted for the specific embodiment shown and described without departing from the scope of the present disclosure. The present disclosure covers all methods, apparatus, and articles of manufacture fairly falling within the scope of the appended claims either literally or under the doctrine of equivalents. This application is intended to cover any adaptations or variations of the embodiment disclosed herein. Therefore, it is manifested and intended that the present disclosure be limited only by the claims and the equivalents thereof.

What is claimed is:

1. A device comprising:

(i) a first wave detector, and (ii) a second wave detector, wherein the second wave detector is separated from the first wave detector by a pre-determined distance;

a first channel configured to receive, at a sampling rate, a signal from the first wave detector, wherein the signal comprises (i) a target signal and (ii) a background signal;

a second channel configured to receive, at the sampling rate, the signal from the second wave detector a time t after the first channel receives the signal, wherein the pre-determined distance by which the second wave detector is separated from the first wave detector is based, at least in part, on the sampling rate;

a delay control circuit configured to iteratively determine a fractional delay to maximize a correlation coefficient between the signal on the first channel and the signal on the second channel;

an adaptive fractional delay filter in the first channel configured to (i) introduce the fractional delay in the signal on the first channel with respect to the signal on the second channel so as to adaptively align, in the digital domain, the signal on the first channel with the signal on the second channel based, at least in part, on the fractional delay, and (ii) introduce an integer delay in the signal on the first channel with respect to the signal on the second channel, wherein the adaptive fractional delay filter comprises:

a first finite impulse response (FIR) filter to impose a first time delay on the signal in the first channel and to produce a first time-delayed signal;

a second FIR filter to impose a second time delay on the signal in the first channel and to produce a second time-delayed signal, wherein the first FIR filter operates in parallel with the second FIR filter, and wherein the first time-delayed signal and the second time-delayed signal are applied to the delay control circuit; and a feedback loop circuit to iteratively apply the fractional delay to the first time-delayed signal; and a group delay circuit in the second channel configured to compensate for the integer delay in the signal on the first channel with respect to the signal on the second channel.

2. The device of claim 1, wherein:

the adaptive fractional delay filter comprises a Farrow Fractional Delay Filter architecture.

3. The device of claim 1, wherein the correlation coefficient comprises a phase correlation coefficient.

4. The device of claim 1, wherein the signal comprises an electromagnetic signal.

5. The device of claim 1, further comprising:

an output port configured to (i) provide the signal on the first channel to a beamformer circuit, wherein the signal on the first channel is delayed by the adaptive fractional delay filter and (ii) provide the signal on the second channel to the beamformer circuit, wherein the beamformer circuit is configured to (i) amplify the target signal and (ii) suppress the background signal.

6. The device of claim 1, wherein:

the delay control circuit is configured to adjust the fractional delay based, at least in part, on signals generated by the adaptive fractional delay filter.

7. The device of claim 1, wherein:

the delay control circuit is configured to iteratively determine the fractional delay based, at least in part, on the sampling rate.

8. A method comprising:

receiving, at a sampling rate, a signal from a first wave detector on a first channel, wherein the signal comprises (i) a target signal and (ii) a background signal;

a time t after the first channel receives the signal, receiving, at the sampling rate, the signal from a second wave detector on a second channel, wherein the first wave detector and the second wave detector are separated by a pre-determined distance that is based, at least in part, on the sampling rate;

in a parallel process, (i) imposing a first time delay on the signal in the first channel to produce a first time-delayed signal and (ii) imposing a second time delay on the signal in the first channel to produce a second time-delayed signal;

iteratively determining, based at least in part on the first time-delayed signal and the second time-delayed signal, a fractional delay to maximize a correlation coefficient between the signal on the first channel and the signal on the second channel;

introducing the fractional delay in the signal on the first channel with respect to the signal on the second channel via a feedback loop circuit that iteratively applies the fractional delay to the first time-delayed signal; and adaptively aligning, in the digital domain, the signal on the first channel with the signal on the second channel based, at least in part, on the fractional delay.

9. The method of claim 8, wherein the signal comprises an audio signal.

10. The method of claim 8, wherein the signal comprises an electromagnetic signal.

11. The method of claim 8, wherein adaptively aligning, in the digital domain, the signal on the first channel with the signal on the second channel is performed by a Farrow Fractional Delay Filter.

12. The method of claim 8, further comprising:

providing (i) the signal on the first channel to a beamformer circuit, wherein the signal on the first channel is delayed by an adaptive fractional delay filter, and (ii) the signal on the second channel to the beamformer circuit;

amplifying, by the beamformer circuit, the target signal; and suppressing, by the beamformer circuit, the background signal.

13. The method of claim 12, the method further comprising:

adjusting the fractional delay based, at least in part, on signals generated by the adaptive fractional delay filter.

14. A system comprising:

(i) a first wave detector and (ii) a second wave detector, wherein the second wave detector is separated from the first wave detector by a pre-determined distance;

a signal source locator circuit configured to receive, at a sampling rate, a signal from the first wave detector on a first channel, wherein the signal comprises (i) a target signal and (ii) a background signal, receive, at the sampling rate, the signal from the second wave detector on a second channel a time t after the first channel receives the signal, wherein the pre-determined distance by which the first wave detector is separated from the second wave detector is based, at least in part, on the sampling rate, in a parallel process, (i) impose a first time delay on the signal in the first channel to produce a first time-delayed signal and (ii) impose a second time delay on the signal in the first channel to produce a second time-delayed signal;

iteratively determine, based at least in part on the first time-delayed signal and the second time-delayed signal, a fractional delay to maximize a correlation coefficient between the signal on the first channel and the signal on the second channel;

introduce the fractional delay in the signal on the first channel with respect to the signal on the second channel via a feedback loop circuit that iteratively applies the fractional delay to the first time-delayed signal;

adaptively align, in the digital domain, the signal on the first channel with the signal on the second channel based, at least in part, on the fractional delay; and introduce an integer delay in the signal on the first channel with respect to the signal on the second channel; and a beamformer circuit configured to amplify the target signal based, at least in part, on (i) the signal adaptively aligned on the first channel and (ii) the signal on the second channel, and suppress the background signal based, at least in part, on (i) the signal delayed on the first channel and (ii) the signal on the second channel.

15. The system of claim 14, wherein the first wave detector is a first audio microphone and the second wave detector is a second audio microphone.

16. The system of claim 14, wherein the signal comprises an electromagnetic signal.

17. The system of claim 14, wherein:

adaptively aligning, in the digital domain, the signal on the first channel with the signal on the second channel is performed by a Farrow Fractional Delay Filter.

18. The system of claim 14, wherein:

the signal source locator circuit is further configured to adjust the fractional delay based, at least in part, on signals generated by an adaptive fractional delay filter.

* * * * *